US005782675A

United States Patent [19]

Southwick

[11] Patent Number: 5,782,675

[45] Date of Patent: Jul. 21, 1998

[54] APPARATUS AND METHOD FOR REFURBISHING FIXED-ABRASIVE POLISHING PADS USED IN CHEMICAL-MECHANICAL PLANARIZATION OF SEMICONDUCTOR WAFERS

[75] Inventor: Scott A. Southwick, Boise, Id.

[73] Assignee: Micron Technology, Inc., Boise, Id.

[21] Appl. No.: 735,804

[22] Filed: Oct. 21, 1996

[51] Int. Cl.[6] ..... B24B 53/00

[52] U.S. Cl. ..... 451/56; 451/41; 451/54; 451/287; 451/444

[58] Field of Search ..... 451/41, 56, 57, 451/54, 285, 287, 288, 289, 443, 444; 15/21.1, 39.5, 88.2, 209.1, 230; 134/34, 93, 172, 198, 902

[56] References Cited

U.S. PATENT DOCUMENTS

| | | | |
|---|---|---|---|
| 3,031,195 | 4/1962 | Lunsford | 274/9 |
| 4,438,601 | 3/1984 | Olson | 451/444 |
| 4,462,188 | 7/1984 | Payne | 451/41 |
| 4,841,684 | 6/1989 | Hall, Jr. | 451/532 |
| 5,081,051 | 1/1992 | Mattingly et al. | 437/10 |
| 5,154,021 | 10/1992 | Bombardier et al. | 51/262 A |
| 5,216,843 | 6/1993 | Breivogel et al. | 51/131.1 |
| 5,245,796 | 9/1993 | Miller et al. | 451/444 |
| 5,384,986 | 1/1995 | Hirose et al. | 451/444 |
| 5,421,768 | 6/1995 | Fujiwara et al. | 451/288 |
| 5,456,627 | 10/1995 | Jackson et al. | 451/56 |
| 5,578,529 | 11/1996 | Mullins | 451/41 |
| 5,616,069 | 4/1997 | Walker et al. | 451/56 |
| 5,618,447 | 4/1997 | Sandhu | 438/14 |
| 5,624,303 | 4/1997 | Robinson | 451/285 |

*Primary Examiner*—Eileen P. Morgan
*Attorney, Agent, or Firm*—Seed & Berry LLP

[57] ABSTRACT

An apparatus and method for refurbishing fixed-abrasive polishing pads. In one embodiment, a refurbishing device has an arm positionable over the planarizing surface of the polishing pad, a refurbishing element attached to one end of the arm, and an actuator connected to the other end of the arm. The refurbishing element has a non-abrasive contact medium engageable with the planarizing surface of the polishing pad that does not abrade or otherwise damage raised features on the fixed-abrasive pad under desired conditioning down forces. The actuator moves the arm downwardly and upwardly with respect to the planarizing surface to engage and disengage the non-abrasive contact medium with the planarizing surface of the polishing pad. The refurbishing device may also have a conditioning solution dispenser positionable proximate to the planarizing surface of the polishing pad to dispense a liquid conditioning solution onto the planarizing surface. The conditioning solution is selected from a liquid that reacts or otherwise interacts with the particular waste matter material to allow the non-abrasive contact medium to remove waste matter material from the polishing pad. As the refurbishing element engages the planarizing surface in the presence of the conditioning solution, at least one of the refurbishing element or the polishing pad moves with respect to the other. In operation, the conditioning solution and the refurbishing element remove waste matter from the pad without abrading or otherwise damaging the planarizing surface of the polishing pad.

29 Claims, 3 Drawing Sheets

APPARATUS AND METHOD FOR REFURBISHING FIXED-ABRASIVE POLISHING PADS USED IN CHEMICAL-MECHANICAL PLANARIZATION OF SEMICONDUCTOR WAFERS

TECHNICAL FIELD

The present invention relates to an apparatus and a method for refurbishing abrasive polishing pads used in chemical-mechanical planarization of semiconductor wafers.

BACKGROUND OF THE INVENTION

Chemical-mechanical planarization ("CMP") processes remove material from the surface of a semiconductor wafer in the production of integrated circuits. FIG. 1 schematically illustrates a CMP machine 10 with a platen 20, a wafer carrier 30, a polishing pad 40, and a planarizing liquid 44 on the polishing pad 40. The polishing pad 40 may be a conventional polishing pad made from a continuous phase matrix material (e.g., polyurethane), or it may be a new generation fixed-abrasive polishing pad made from abrasive particles fixedly dispersed in a suspension medium. The planarizing liquid 44 may be a conventional CMP slurry with abrasive particles and chemicals that remove material from the wafer, or the planarizing liquid 44 may be a planarizing solution without abrasive particles. In most CMP applications, conventional CMP slurries are used on conventional polishing pads, and planarizing solutions without abrasive particles are used on fixed-abrasive polishing pads.

The CMP machine 10 also has an under-pad 25 attached to an upper surface 22 of the platen 20 and the lower surface of the polishing pad 40. A drive assembly 26 rotates the platen 20 (as indicated by arrow A), or it reciprocates the platen back and forth (as indicated by arrow B). Since the polishing pad 40 is attached to the under-pad 25, the polishing pad 40 moves with the platen 20.

The wafer carrier 30 has a lower surface 32 to which a wafer 12 may be attached, or the wafer 12 may be attached to a resilient pad 34 positioned between the wafer 12 and the lower surface 32. The wafer carrier 30 may be a weighted, free-floating wafer carrier; or an actuator assembly 36 may be attached to the wafer carrier to impart axial and/or rotational motion (as indicated by arrows C and D, respectively).

To planarize the wafer 12 with the CMP machine 10, the wafer carrier 30 presses the wafer 12 face-downward against the polishing pad 40. While the face of the wafer 12 presses against the polishing pad 40, at least one of the platen 20 or the wafer carrier 30 moves relative to the other to move the wafer 12 across the planarizing surface 42. As the face of the wafer 12 moves across the planarizing surface 42, material is continuously removed from the face of the wafer 12.

One problem with CMP processing is that the throughput may drop, and the uniformity of the polished surface on the wafer may be inadequate, because waste particles from the wafer accumulate on the planarizing surface 42 of the polishing pad 40. The problem is particularly acute when planarizing doped silicon oxide layers because doping softens silicon oxide and makes it slightly viscous as it is planarized. As a result, accumulations of doped silicon oxide glaze the planarizing surface of the polishing pad with a coating that substantially reduces the polishing rate over the glazed regions.

To return the polishing pads to an adequate state for planarizing additional wafers, the polishing pads are typically conditioned by removing the accumulations of waste matter with an abrasive disk. Conventional abrasive conditioning disks are generally embedded with diamond particles, and they are mounted to a separate actuator on a CMP machine that sweeps them across the polishing pad. Typical abrasive disk pad conditioners remove a thin layer of the pad material itself in addition to the waste matter to form a new, clean planarizing surface on the polishing pad. Some abrasive disk pad conditioners also use a liquid solution that dissolves some of the waste matter as the abrasive disks abrade the polishing surface.

Although conventional diamond-embedded abrasive disks are well suited to condition conventional polishing pads, they may not be well suited to condition the new generation of fixed-abrasive polishing pads. Fixed-abrasive polishing pads generally have exposed abrasive particles across their planarizing surfaces. Additionally, fixed-abrasive pads may have topographical features across their planarizing surface. When a fixed-abrasive polishing pad is conditioned with a diamond-embedded abrasive disk, the diamonds not only remove waste matter material, but they also remove abrasive particles and may damage other features on the planarizing surface of the polishing pad. Conditioning a fixed-abrasive polishing pad with a diamond-embedded disk will likely alter the planarizing surface, and thus the planarizing properties, of the polishing pad. Therefore, conventional pad conditioning processes do not work with the new generation of fixed-abrasive polishing pads.

SUMMARY OF THE INVENTION

The present invention is an apparatus and method for refurbishing abrasive polishing pads. In one embodiment, the refurbishing device has an arm positionable over the planarizing surface of the polishing pad, a refurbishing element attached to one end of the arm, and an actuator connected to the other end of the arm. The refurbishing element has a non-abrasive contact medium engageable with the planarizing surface of the polishing pad that does not abrade or otherwise damage raised features on the fixed-abrasive pad under desired conditioning down forces. The actuator moves the arm downwardly and upwardly with respect to the planarizing surface to engage and disengage the non-abrasive contact medium with the planarizing surface of the polishing pad. In a preferred embodiment, the refurbishing device also has a conditioning solution dispenser positionable proximate to the planarizing surface of the polishing pad to dispense a liquid conditioning solution onto the planarizing surface. The conditioning solution is selected from a liquid that reacts with the particular waste matter material to allow the non-abrasive contact medium to remove waste matter material from the polishing pad. As the refurbishing element engages the planarizing surface in the presence of the conditioning solution, at least one of the refurbishing element or the polishing pad moves with respect to the other. In operation, the conditioning solution and the refurbishing element remove waste matter from the pad without abrading or otherwise damaging the planarizing surface of the polishing pad.

In a preferred embodiment, a planarizing machine for chemical-mechanical planarization of a semiconductor wafer has a platen mounted to a support structure and a fixed-abrasive polishing pad positioned on the platen. The fixed-abrasive polishing pad has a suspension medium, a plurality of abrasive particles fixedly dispersed in the suspension medium, and a planarizing surface with exposed abrasive particles. The planarizing machine also has a movable wafer carrier adapted to hold the wafer and engage the wafer with the planarizing surface of the polishing pad. At least one of the platen or the wafer carrier moves with respect to the other to impart relative motion between the wafer and the planarizing surface of the polishing pad. In one embodiment, the planarizing machine has a refurbishing element carriage positioned proximate to the polishing pad, a non-abrasive refurbishing element attached to the carriage, and a solution dispenser positioned proximate to the pad. The refurbishing element carriage has an arm positionable over the planarizing surface and an actuator for moving the arm towards or away from the planarizing surface. The non-abrasive refurbishing element is preferably attached to the arm of the carriage.

In operation, the carriage moves the non-abrasive refurbishing element into engagement with the planarizing surface of the polishing pad as at least one of the carriage and the polishing pad moves with respect to the other to impart relative motion therebetween. A conditioning solution selected to dissolve or oxidize the waste matter material is simultaneously deposited onto the polishing pad. The conditioning solution breaks down the waste matter so that the non-abrasive refurbishing element can remove the waste matter material from the polishing pad without damaging the planarizing surface.

In a method of conditioning a fixed-abrasive polishing pad in accordance with the invention, a conditioning solution that dissolves, oxidizes, or otherwise breaks down the waste matter material is deposited onto at least a portion of the planarizing surface of the fixed-abrasive polishing pad. A non-abrasive refurbishing element is pressed against the planarizing surface in the presence of the conditioning solution, and at least one of the fixed-abrasive polishing pad or the non-abrasive refurbishing element is moved with respect to the other to impart relative motion therebetween. As the refurbishing element moves against the planarizing surface, the conditioning solution and the non-abrasive refurbishing element remove the waste matter material from the planarizing surface without eroding the topography of the planarizing surface.

DETAILED DESCRIPTION OF THE INVENTION

The present invention is a pad refurbishing device that removes waste material from fixed-abrasive polishing pads without abrading or otherwise damaging the planarizing surface of the fixed-abrasive pads. An important aspect of an embodiment of the refurbishing device is to provide a conditioning solution that breaks down the waste matter material to a state in which it may be removed with a relatively low mechanical force. Another important aspect of an embodiment of the refurbishing device is to provide a non-abrasive refurbishing element that engages the planarizing surface and removes the waste matter without abrading or otherwise damaging raised features on the polishing pad. FIGS. 2–5B, in which like reference numbers refer to like parts throughout the various figures, illustrate some embodiments of pad refurbishing devices and non-abrasive pad refurbishing elements in accordance with the invention.

Figure 1:
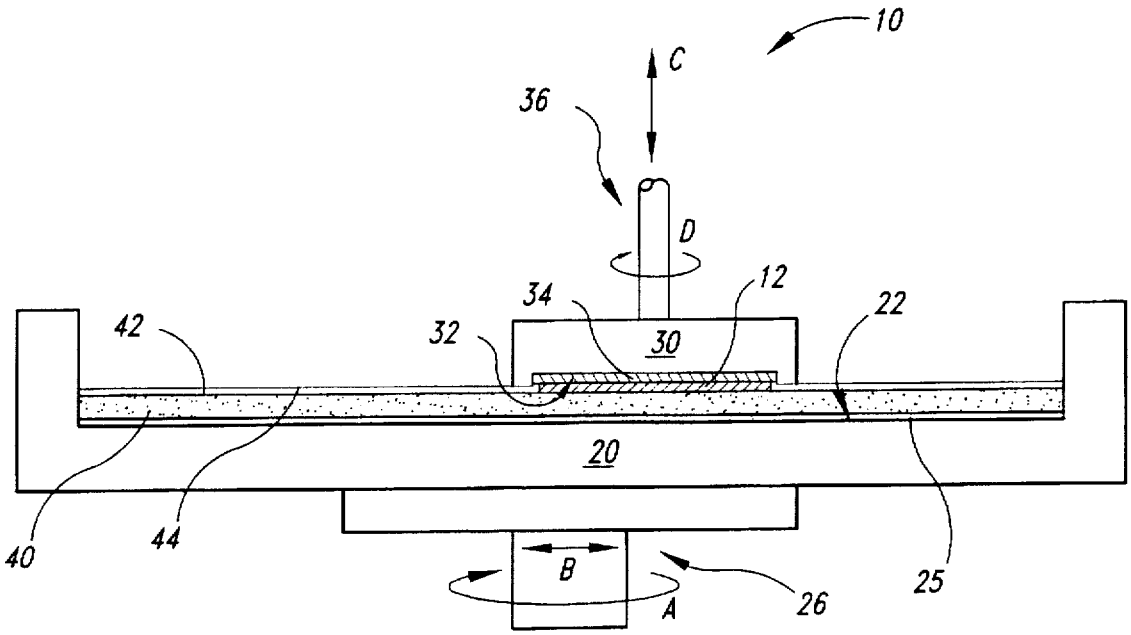
Fig. 1 (PRIOR ART)
FIG. 1 is a schematic view of a chemical-mechanical planarization machine in accordance with the prior art.
Figure 2:
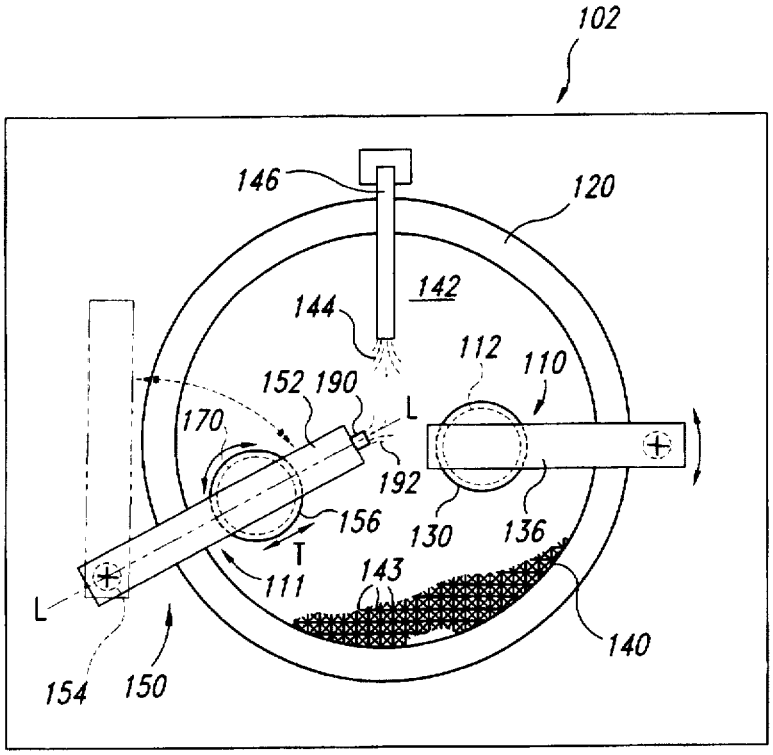
FIG. 2 is a schematic top plan view of an embodiment of a pad refurbishing device in accordance with the invention.
Figure 3:
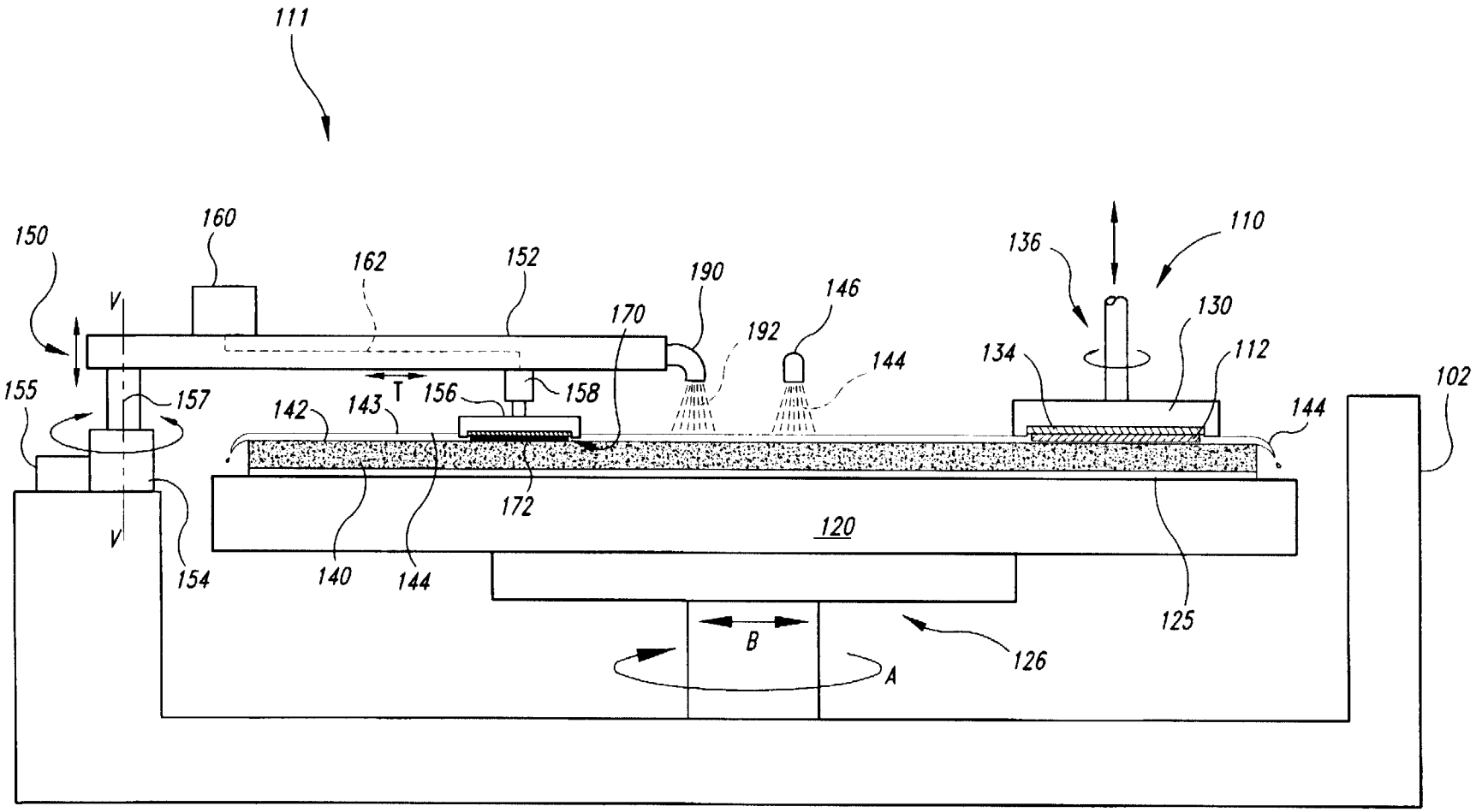
FIG. 3 is a schematic side elevational view of the pad refurbishing device of FIG. 2.

FIGS. 2 and 3 illustrate a chemical-mechanical planarization machine 102 with a wafer planarizing mechanism 110, a pad refurbishing device 111, and a platen 120. As discussed above in FIG. 1, a wafer carrier 130 is attached to an actuator 136 that moves the wafer carrier 130 with respect to a fixed-abrasive polishing pad 140 on the platen 120. Additionally, a solution 144 is deposited onto the planarizing surface 142 of the fixed-abrasive pad 140 by a solution dispenser 146 positioned proximate to the polishing pad 140. A wafer 112 mounted to the wafer carrier 130 is planarized on a planarizing surface 142 of the fixed-abrasive pad 140. A suitable wafer planarizing mechanism 110 and platen 120 are manufactured by IPEC/Westech Systems, Inc., of Phoenix, Ariz.

The pad refurbishing device 111 preferably has a non-abrasive refurbishing element 170 mounted to a refurbishing element carrier 156 of a carriage assembly 150. The refurbishing element 170 has a non-abrasive contact medium 172 (shown only in FIG. 2) that engages the planarizing surface 142 of the fixed-abrasive pad 140 to scrub waste matter from the planarizing surface 142 without abrading or damaging raised features 143 on the fixed-abrasive pad 140. The refurbishing element 170 is preferably a brush, and thus the contact medium 172 is preferably a plurality of resilient, flexible bristles extending downwardly towards the planarizing surface 142 of the polishing pad 140.

The refurbishing element carriage assembly 150 has an arm 152 positionable over the planarizing surface 142 of the fixed-abrasive pad 140, an actuator 154 connected to the arm 152, and the refurbishing element carrier 156 attached to the arm 152. The actuator 154 raises and lowers the arm 152 with respect to the fixed-abrasive pad 140 to engage the refurbishing element 170 with the planarizing surface 142. The actuator 154 is preferably a cylinder that moves a rod 157 upwardly and downwardly with respect to the planarizing surface 142 of the polishing pad 140, and a motor 155 is preferably attached to the actuator 154 for rotating the actuator 154 and the arm 152 about an axis V—V (best shown in FIG. 3). The actuator 154 preferably presses the refurbishing element 170 against the polishing pad 140 with a pressure of between approximately 2 psi and approximately 50 psi, and more preferably between 5 psi and 9 psi.

In a preferred embodiment, a second actuator 160 is operatively coupled to the refurbishing element carrier 156 by a connector 162 to translate the carrier 156 and refurbishing element 170 along the longitudinal axis L—L of the arm 152 (shown by arrow T). The connector 162 (shown in FIG. 2) for translating the carrier 156 may be a long threaded screw drive threadedly engaged with a threaded block 157 and driven by the second actuator 160. In another embodiment, the second actuator 160 may be a cylinder (not shown) mounted along the L—L axis of the arm 152, and the connector 162 may be the cylinder rod (not shown). Also, a separate solution dispenser 190 is preferably attached to the arm 152 for depositing a conditioning solution 192 or other liquid onto the planarizing surface 142 of the fixed-abrasive pad 140. One refurbishing element carriage assembly 150 suitable for use with the invention is manufactured by IPEC/Westech Systems, Inc., of Phoenix, Ariz., and disclosed in U.S. Pat. No. 5,456,627, entitled "CONDITIONER FOR A POLISHING PAD AND METHOD THEREFOR," which is herein incorporated by reference.

Figure 4:
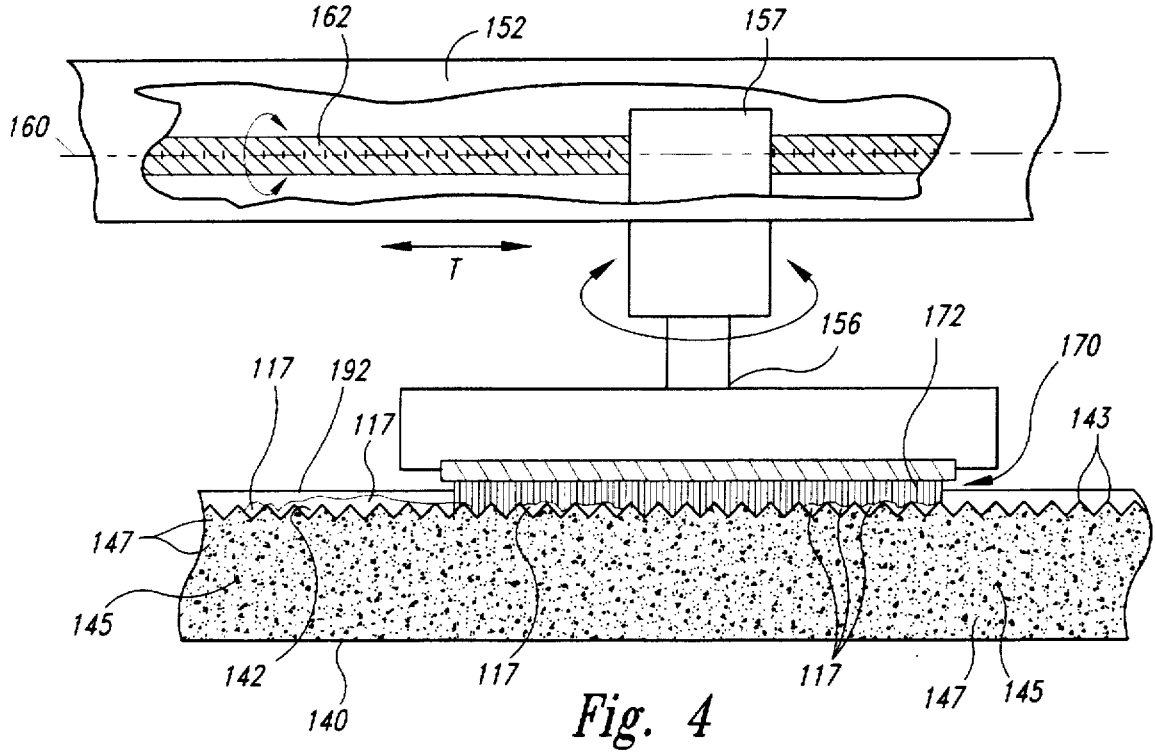
FIG. 4 is a schematic partial cross-sectional view of a non-abrasive refurbishing element conditioning a fixed-abrasive polishing pad in accordance with the invention.

FIG. 4 illustrates a preferred embodiment of the refurbishing element 170 as it conditions the fixed-abrasive pad 140. The refurbishing element carrier 156 presses the refurbishing element 170 against the fixed-abrasive pad 140 and moves the non-abrasive contact medium 172 across the raised features 143 of the fixed-abrasive pad 140. In this embodiment, the refurbishing element 170 is a brush with a non-abrasive contact medium 172 composed of a plurality of bristles.

The bristles of the non-abrasive contact element 172 are preferably made from a resilient, flexible material so that they deflect under the influence of the down force without abrading the fixed-abrasive pad 140 or otherwise damaging the raised features 143. The bristles are preferably long enough to reach the lower points of the planarizing surface 142, but short enough so that they are sufficiently stiff to scrub the waste matter 117. In a preferred embodiment, the refurbishing element 170 is a pad with nylon bristles having a length between 0.1 and 0.5 inches, and the density of the bristles is preferably between 100–2000 bristles/in$^2$. The bristles, however, may be made from other material, have different lengths, and be mounted to a brush with different densities. Other suitable materials from which the bristles may be made include natural fibers; polyvinyl chloride; polyethylene; polypropylene; polystyrene; polyvinyl acetate; acrylics; polyester; ABS polymers; and polyacrylonitrile. Suitable refurbishing elements 170 are manufactured by 3M Corporation of St. Paul, Minn.

Still referring to FIG. 4, the conditioning solution 192 deposited onto the planarizing surface 142 of the polishing pad 140 reacts with the waste matter material 117 so that the non-abrasive refurbishing element 170 removes the waste matter material 117 from the polishing pad without damaging the raised features 143. As a result, the conditioning solution 192 allows a non-abrasive refurbishing element 170 to have a non-abrasive contact medium 172 that is much less mechanically aggressive compared to the diamond-embedded conditioning disks of conventional conditioning devices. Thus, a central aspect of non-abrasive contact mediums 172 in accordance with the invention is that they do not ordinarily abrade or damage the abrasive particles 147 or the suspension media 145 of fixed-abrasive polishing pads under normal down forces of between approximately 2 and approximately 50 psi.

The conditioning solution 192 is also selected to either provide in situ or ex situ conditioning of the fixed-abrasive polishing pad 140. In situ conditioning requires that the conditioning solution 192 be compatible with the planarizing fluid and the material being planarized on the wafer 112 (shown in FIGS. 2 and 3). For in situ conditioning, the conditioning solution preferably has a pH selected to oxidize or otherwise react with the waste matter material without causing an uncontrollable etch to occur on the surface of the wafer. In a preferred embodiment of in situ conditioning, the conditioning solution 192 is preferably the same as the planarizing solution used on the fixed-abrasive polishing pad during CMP of the wafer 112. Therefore, the conditioning solution 192 may be dispensed onto the polishing pad through either the solution dispenser 146 or the solution dispenser 190 depending upon the compatibility between the conditioning solution 192 and the planarizing solution 144.

Specific examples of suitable in situ conditioning solutions are generally categorized by whether the waste matter is polysilicon or a metal. When a layer of polysilicon or doped polysilicon is being planarized, a conditioning solution of ammonium hydroxide ($NH_4OH$) or tetramethyl ammonium hydroxide may be used to remove polysilicon waste matter material from the fixed-abrasive pad. In another example, when a metal layer is being planarized, a conditioning solution of hydrogen peroxide, potassium iodate, ferric nitrate, bromide, and other solutions that have a pH of generally less than 5.0 may be used to remove metal waste matter material.

In the case of ex situ conditioning, the conditioning solution is preferably selected to dissolve the waste matter material without reacting with the polishing pad 140. The range of suitable conditioning solutions 192 is broader for ex situ conditioning than for in situ conditioning because the effect of the conditioning solution 192 on the wafer is not a concern in ex situ conditioning. Therefore, a hydrofluoric acid (HF) solution may be used to condition waste matter accumulations on the fixed-abrasive pad 140. Additionally, solutions of hydrogen peroxide, potassium iodate, ferric nitrate, and bromine that have a pH over 5.0 may be used to remove metal waste matter accumulations from the fixed-abrasive pad 140.

Figure 5A:
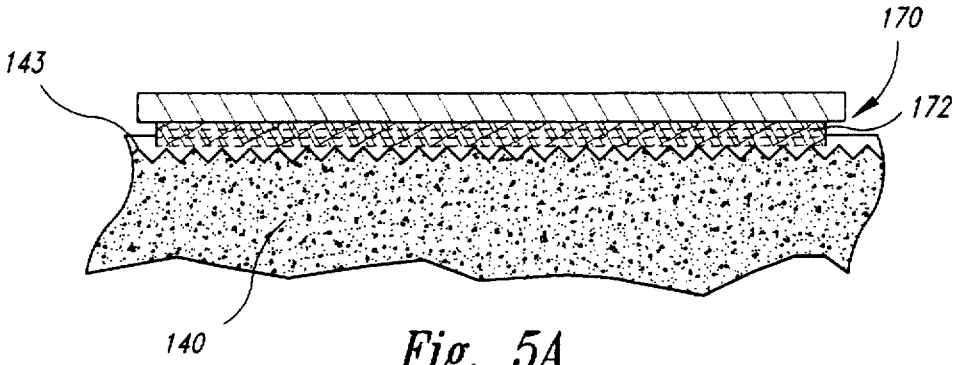
FIG. 5A is a schematic cross-sectional view of another non-abrasive refurbishing element in accordance with the invention.
Figure 5B:
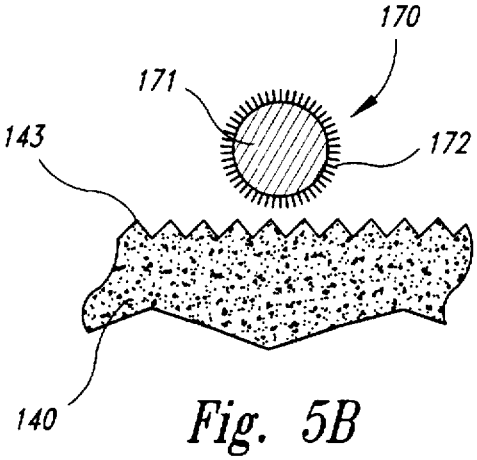
FIG. 5B is a schematic cross-sectional view of another non-abrasive refurbishing element in accordance with the invention.

FIGS. 5A and 5B illustrate additional embodiments of non-abrasive refurbishing elements 170 in accordance with the invention. Referring to FIG. 5A, the refurbishing element 170 is a pad with a non-abrasive contact medium 172 composed of randomly oriented fibers that form a flocculant medium. The fibers of the non-abrasive contact medium 172 are preferably made from a resilient, flexible polymeric material such as nylon. Referring to FIG. 5B, the non-abrasive refurbishing element 170 is a roller with a non-abrasive contact medium 172 that is either a plurality of bristles or a pad of randomly oriented fibers. As discussed above, however, the fibers may be made from other suitable materials. In operation, the non-abrasive refurbishing element 170 shown in FIG. 5B rotates in a direction R as the non-abrasive contact medium 172 is pressed against raised features of a fixed-abrasive pad.

One advantage of a preferred embodiment of the pad refurbishing device 111 is that glazed waste matter material may be removed from fixed-abrasive polishing pads without abrading or otherwise damaging raised features on the fixed-abrasive pads. Referring to FIG. 4, it will be appreciated that conventional diamond-embedded abrasive conditioning disks will not only remove the waste matter accumulations 117, but they will also abrade the planarizing surface 142 and damage the raised features 143 on the fixed-abrasive pad 140. In a preferred embodiment of the present invention, however, the conditioning solution 192 reacts with the waste matter material 117 to reduce it to a state in which the non-abrasive contact medium 172 can remove it without abrading or damaging the raised features 143. Therefore, a preferred embodiment of the refurbishing device 111 of the CMP machine 102 effectively refurbishes fixed-abrasive pads to bring them into a desired condition for planarizing subsequent wafers.

Another advantage of the preferred embodiment of the present invention is that both fixed-abrasive polishing pads and conventional polishing pads may be conditioned in situ and in real time while a wafer is planarized. In situ conditioning generally is not performed with conventional diamond-embedded disks because the diamond-embedded disks break relatively large particles from the pad that may scratch the surface of the wafer under typical CMP conditions. The preferred embodiment of the conditioning machine 102 of the present invention, however, is not expected to break particles away from the pad or the waste matter material because the non-abrasive refurbishing element does not abrade the waste matter material or the pad. Therefore, it is expected that both fixed-abrasive polishing pads and conventional polishing pads may be refurbished in situ while a wafer is planarized without scratching the surface of the wafer.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A planarizing machine for chemical-mechanical planarization of a semiconductor wafer, comprising:

a platen mounted to a support structure;

a fixed-abrasive polishing pad positioned on the platen, the abrasive polishing pad having a suspension medium, a plurality of abrasive particles fixedly suspended within the suspension medium, and a planarizing surface with a plurality of exposed abrasive particles;

a movable wafer carrier to which the wafer is mounted, the wafer carrier being positionable over the abrasive polishing pad and adapted to engage the wafer with the planarizing surface of the abrasive polishing pad, wherein at least one of the platen and the wafer carrier moves with respect to the other to impart relative motion between the wafer and the abrasive polishing pad;

a liquid solution dispenser positioned proximate to the planarizing surface of the polishing pad, the solution dispenser being connected to a supply of conditioning solution that interacts with the waste matter material to form an interacted waste material;

a carriage assembly positioned proximate to the abrasive polishing pad, the carriage assembly having an arm positionable over the planarizing surface and an actuator for moving the arm with respect to the planarizing surface; and a non-abrasive refurbishing element attached to the arm, wherein the refurbishing element removes the interacted material from the abrasive polishing pad without abrading the planarizing surface as at least one of the refurbishing element and the abrasive polishing pad moves with respect to the other.

2. The planarizing machine of claim 1 wherein the refurbishing element comprises a brush having a plurality of resilient bristles.

3. The planarizing machine of claim 2 wherein the bristles are nylon.

4. The planarizing machine of claim 2 wherein the bristles have a density of between approximately 100 and approximately 2000 bristles per square inch.

5. The planarizing machine of claim 2 wherein the bristles have a length of between approximately 0.1 and 0.5 inches.

6. The planarizing machine of claim 1, further comprising a motor operatively attached to the actuator to rotate the actuator and the arm to sweep the contact medium across the planarizing surface of the abrasive polishing pad.

7. The planarizing machine of claim 1, further comprising a second actuator operatively connected to the refurbishing element to move the refurbishing element along the arm.

8. A method for removing waste matter material from a planarizing surface of a fixed-abrasive polishing pad used in chemical-mechanical planarization of a semiconductor wafer, the abrasive polishing pad having a suspension medium, a plurality of abrasive particles fixedly suspended within the suspension medium, and a planarizing surface with a plurality of exposed abrasive particles, the method comprising the steps of:

depositing a conditioning solution onto the planarizing surface that reacts with the waste matter material to form reacted waste matter material that may be removed with a first frictional force;

pressing a non-abrasive refurbishing element against the planarizing surface in the presence of the conditioning solution with a force greater than the first frictional force and less than a second frictional force at which the refurbishing element abrades the polishing pad; and moving at least one of the fixed-abrasive pad and the non-abrasive refurbishing element with respect to the other to impart relative motion therebetween, the non-abrasive refurbishing element dislodging and removing the reacted waste matter material from the planarizing surface without substantially abrading the planarizing surface of the fixed-abrasive polishing pad.

9. The method of claim 8 wherein the depositing step comprises coating at least a portion of the planarizing surface with a solution of ammonium hydroxide.

10. The method of claim 8 wherein the depositing step comprises coating at least a portion of the planarizing surface with a solution of tetramethyl ammonium hydroxide.

11. The method of claim 8 wherein the depositing step comprises coating at least a portion of the planarizing surface with a solution of potassium iodate.

12. The method of claim 8 wherein the depositing step comprises coating at least a portion of the planarizing surface with a solution of ferric nitrate.

13. The method of claim 8 wherein the depositing step comprises coating at least a portion of the planarizing surface with a solution having a pH less than 5.0.

14. The method of claim 8 wherein the depositing step comprises coating at least a portion of the planarizing surface with a solution having a pH greater than 5.0.

15. The method of claim 8 wherein the depositing step comprises coating at least a portion of the planarizing surface with a solution having a pH greater than 10.0.

16. The method of claim 8 wherein the refurbishing element is a brush having resilient bristles, and wherein the pressing step further comprises engaging the bristles with the planarizing surface with a force between approximately 2 and approximately 50 psi.

17. The method of claim 8 wherein the refurbishing element is a fibrous pad having a plurality of filaments formed into a flocculant mass, and wherein the pressing step further comprises engaging the filaments with the planarizing surface with a force between approximately 2 and approximately 50 psi.

18. A method for planarizing a semiconductor wafer, comprising:

providing a fixed-abrasive polishing pad having a suspension medium, a plurality of abrasive particles fixedly dispersed in the suspension media, and a planarizing surface with a plurality of exposed abrasive particles;

depositing a liquid solution that breaks down waste matter material onto at least a portion of the planarizing surface of the fixed-abrasive polishing pad;

pressing a non-abrasive refurbishing element against the planarizing surface in the presence of the conditioning solution;

engaging the wafer with the planarizing surface; and moving the fixed-abrasive pad with respect to the non-abrasive refurbishing element and the wafer, wherein the planarizing surface removes material from the wafer, and wherein the conditioning solution and the non-abrasive refurbishing element remove the waste matter material from the planarizing surface without substantially altering the exposed abrasive particles at the planarizing surface of the polishing pad.

19. The method of claim 8 wherein the depositing step comprises coating at least a portion of the planarizing surface with a solution of ammonium hydroxide.

20. The method of claim 8 wherein the depositing step comprises coating at least a portion of the planarizing surface with a solution of tetramethyl ammonium hydroxide.

21. The method of claim 18 wherein the depositing step comprises coating at least a portion of the planarizing surface with a solution of potassium iodate.

22. The method of claim 18 wherein the depositing step comprises coating at least a portion of the planarizing surface with a solution of ferric nitrate.

23. The method of claim 18 wherein the depositing step comprises coating at least a portion of the planarizing surface with a solution having a pH less than 5.0.

24. The method of claim 18 wherein the depositing step comprises coating at least a portion of the planarizing surface with a solution having a pH greater than 10.0.

25. The method of claim 18 wherein the refurbishing element is a brush having resilient bristles, and wherein the pressing step further comprises forcing the bristles against the planarizing surface with a force between approximately 2 and approximately 50 psi.

26. The method of claim 18 wherein the refurbishing element is a fibrous pad having a plurality of filaments formed into a flocculant mass, and wherein the pressing step further comprises forcing the filaments against the planarizing surface with a force between approximately 2 and approximately 50 psi.

27. A method for planarizing a semiconductor wafer, comprising:

providing a fixed-abrasive polishing pad having a suspension medium, a plurality of abrasive particles fixedly suspended in the suspension medium, and a planarizing surface with a plurality of exposed abrasive particles;

translating at least one of the fixed-abrasive polishing pad and the semiconductor wafer with respect to the other to impart relative motion therebetween;

pressing the semiconductor wafer against the fixed-abrasive polishing pad to remove material from the wafer; and engaging a non-abrasive refurbishing element with the planarizing surface, wherein the non-abrasive refurbishing element removes waste matter material from the planarizing surface without substantially altering the exposed abrasive particles at the planarizing surface.

28. The method of claim 27, further comprising removing the semiconductor wafer from the fixed-abrasive polishing pad prior to the step of engaging the non-abrasive refurbishing element with the planarizing surface.

29. The method of claim 27 wherein the step of engaging the non-abrasive refurbishing element with the planarizing surface occurs during the step of pressing the semiconductor wafer against the fixed-abrasive polishing pad.

* * * * *